United States Patent [19]

Yoshida et al.

[11] Patent Number: 4,908,049

[45] Date of Patent: Mar. 13, 1990

[54] SPHERICAL CYCLONE

[75] Inventors: Yasunobu Yoshida, 1-25-8, Torigoe, Taito-ku, Tokyo; Kazumitsu Karasawa, Tokyo, both of Japan

[73] Assignee: Yasunobu Yoshida, Tokyo, Japan

[21] Appl. No.: 245,668

[22] Filed: Sep. 16, 1988

[30] Foreign Application Priority Data

Sep. 17, 1987 [JP] Japan ..... 62-141977[U]

[51] Int. Cl.[4] ..... B04C 5/081

[52] U.S. Cl. ..... 55/227; 55/238; 55/409; 55/459.1; 209/144

[58] Field of Search ..... 55/204, 227, 237, 238, 55/337, 409, 417, 459.1; 209/144

[56] References Cited

U.S. PATENT DOCUMENTS

| | | | |
|---|---|---|---|
| 2,756,837 | 7/1956 | Lovelady et al. | 55/204 |
| 2,893,510 | 7/1959 | Spann | 55/204 |
| 3,477,208 | 11/1969 | Keller, Sr. | 55/462 |
| 3,751,882 | 8/1973 | Phillips | 55/238 |
| 3,853,513 | 12/1974 | Carson | 55/337 |
| 3,873,283 | 3/1975 | Hamblin | 55/424 |
| 3,922,151 | 11/1975 | Kiss et al. | 55/237 |
| 3,948,774 | 4/1976 | Lindman | 210/275 |
| 4,059,419 | 11/1977 | Ross | 55/237 |
| 4,279,627 | 7/1981 | Paul et al. | 55/238 |
| 4,302,226 | 11/1981 | Rafson et al. | 55/238 |
| 4,734,109 | 3/1988 | Cox | 55/238 |

FOREIGN PATENT DOCUMENTS

| | | | |
|---|---|---|---|
| 2042907 | 3/1972 | Fed. Rep. of Germany | 55/459.1 |

*Primary Examiner*—Jay H. Woo
*Assistant Examiner*—C. Scott Bushey
*Attorney, Agent, or Firm*—Cushman, Darby & Cushman

[57] ABSTRACT

Disclosed is a cyclone whose body has a form of a sphere. The spherical form of the cyclone causes the volume of the cyclone to be compact. Further, this allows the pressure loss in the body to be reduced with an advantage that the cyclone can be operated by a blower whose gas volume is smaller.

10 Claims, 3 Drawing Sheets

SPHERICAL CYCLONE

BACKGROUND OF THE INVENTION

1. Field of the Invention

The present invention relates to a spherical cyclone which separates solid or liquid particles mixed with gases and floating therein into clean gases and particles.

2. Description of the Prior Art

There is generally known a cyclone as a means for separating solid or liquid particles mixed with gases and floating therein into clean gases and particles.

A conventional cyclone will be described in reference to drawings.

FIG. 5 shows a front sectional view of a conventional cyclone. FIG. 6 shows the plan view.

As shown in FIGS. 5 and 6, a conventional cyclone B consists of a body 101 which separates particles from gases, an introduction pipe 102 which introduces particle-containing gases into the body, a gas exhaust pipe 103 which exhausts the gases separated from the particles within the body therefrom and a particle ejection pipe 104 which ejects the particles separated from the gases within the body therefrom.

The body 101 consists of an upper cylindrical portion 101*a* and a lower conical portion 101*b*.

The particle-containing gases which have been introduced into the body 101 through the introduction pipe 102 are caused to descend whirling along the inner wall surfaces of the upper portion 101*a*. During this period of time the particles are subjected to a centrifugal force to move towards the direction of the wall of the upper portion 101*a* for separation from the whirling stream. The separated particles descend along the inner wall of the lower portion 101*b* to be ejected from the particle ejection pipe 104 to the outside of the body 101. The gases separated from the particles are reduced in whirling or rotating diameter. Then an ascending current is formed at the center of the current. The gases are exhausted through the gas exhaust pipe 103 out of the body 101.

According to the conventional technology as stated above, the body of the cyclone is composed of an upper cylindrical portion and a lower conical portion, so that the entire structure has to be vertically long, resulting in an impossibility of making it compact. A whirling current is developed in the upper part of the cylindrical portion of this cyclone to separate the particles by a centrifugal force. The cylindrical structure of the upper portion causes the pressure loss of the current to be increased, which requires a blower generating a large gas volume.

The purpose of this invention is to provide a spherical cyclone which is compact in volume, low in pressure loss and works with a blower which develops a small gas volume to solve the above problems.

SUMMARY OF THE INVENTION

To solve the problems stated above the cyclone according to the present invention is constituted as follows:

A cyclone is characterized in that a body thereof is constituted in the form of a sphere, the cyclone being operated to separate particles which are mixed with and floated in gases.

The cyclone according to the present invention works as follows:

Gases which contain particles are descended along the inner wall surface of the cyclone body, rotating in a state of a whirling current. During this period of time a centrifugal force is developed in the particles. The particles are moved in the direction of the wall of the body of the cyclone to be separated from the gases. The current becomes a whirling current which descends rotating in a state of a vortex, causing the pressure loss of the current to be low.

DESCRIPTION OF THE PREFERRED EMBODIMENTS

Preferred embodiments according to the present invention will be explained in reference to the drawings.

Figure 1:
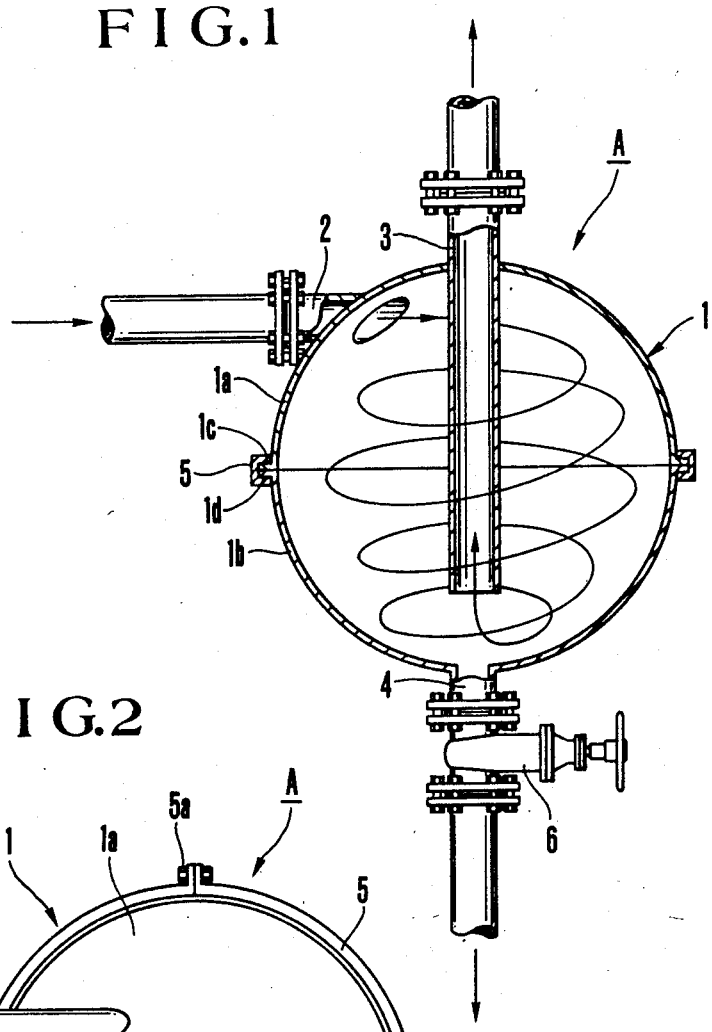
FIG. 1 is a front sectional view which shows an embodiment according to the present invention.
Figure 2:
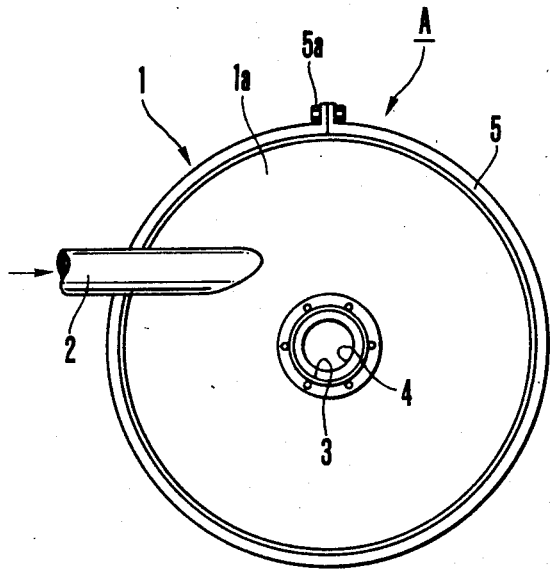
FIG. 2 is a plan view which shows an embodiment according to the present invention.
Figure 3:
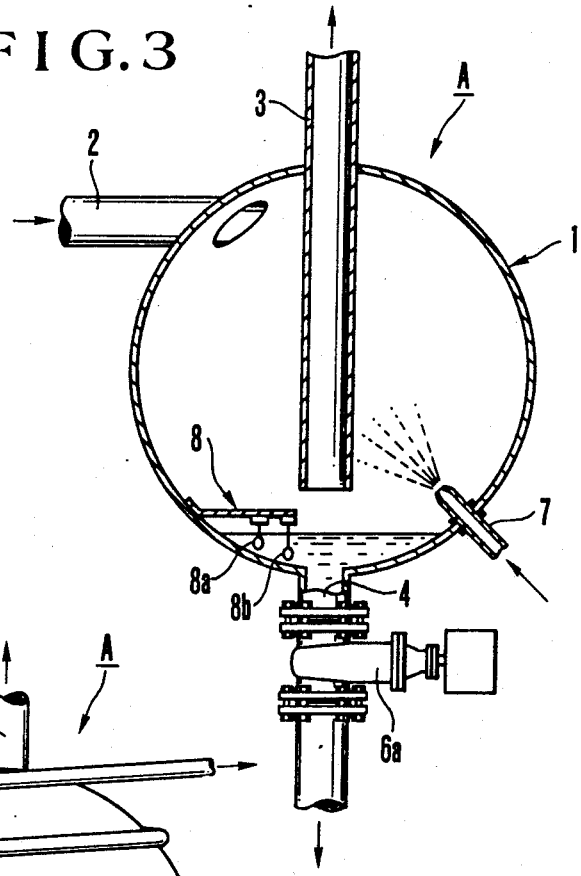
FIG. 3 is an explanatory view which shows a case where an embodiment is provided with a spraying nozzle.
Figure 4:
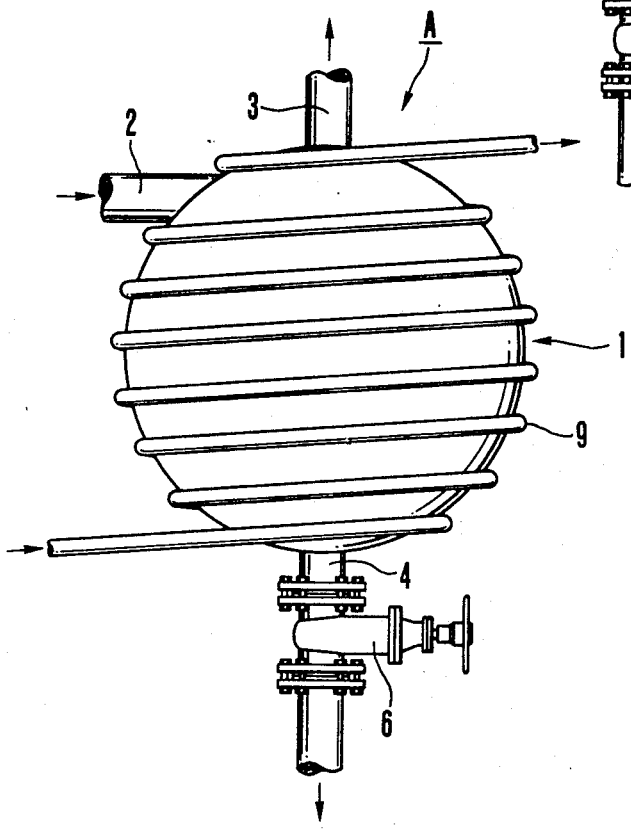
FIG. 4 is an explanatory view which shows a case where an embodiment is provided with a cooling/heating pipe which is coiled around the body 1.
Figure 5:
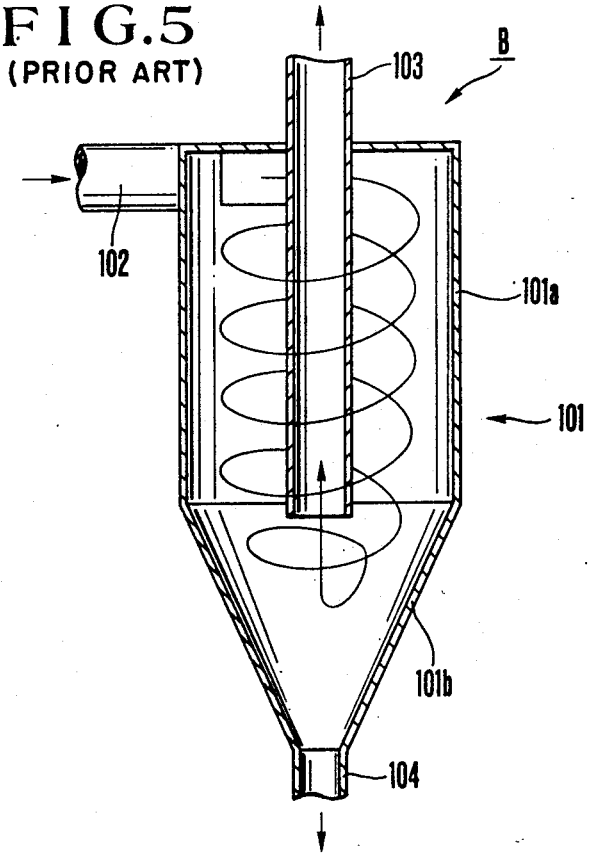
FIG.5 (PRIOR ART)
FIG. 5 is a front sectional view which shows a conventional example.
Figure 6:
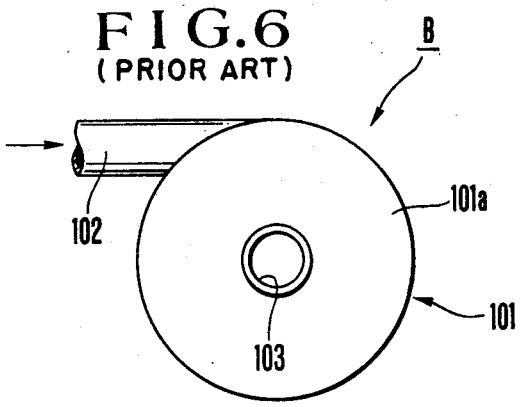
FIG.6 (PRIOR ART)
FIG. 6 is a plan view which shows the conventional example of FIG. 5.

FIG. 1 is a front sectional view which shows an embodiment according to the present invention; FIG. 2 is a plan view which shows an embodiment according to the present invention; FIG. 3 is an explanatory view which shows a case where an embodiment is provided with a spraying nozzle; FIG. 4 is an explanatory view which shows a case where an embodiment is provided with a cooling/heating pipe which is coiled around the body 1.

As shown in FIGS. 1 and 2, a spherical cyclone A is composed of a spherical body 1 which separates particles from gases, an introduction pipe 2 which introduces particle-containing gases into the body 1, a gas exhaust pipe 3 which exhausts to the outside the gases which have been separated from the particles in the body and a particle ejection pipe 4 which ejects to the outside the particles which have been separated in the body.

The above-stated body 1 has a structure where the body is divided into two at the center thereof. The body is composed of an upper spherical portion 1*a* and an lower spherical portion 1*b*. A ring-shaped edge portion 1*c* which extrudes to the outer direction is formed at the opening end part of the upper portion 1*a*. A ring-shaped edge portion 1*d* which extrudes to the outer direction is formed at the opening end part of the lower portion 1*b*. In order to put the upper spherical portion 1*a* and the lower spherical portion 1*b* together a ring-shaped packing is inserted between the ring-shaped edge portion 1*c* and the ring-shaped edge portion 1*d*. Then both the ring-shaped edge portions 1*c* and 1*d* are inserted into the grooved portion of a ring band the cross-section of which is substantially U in shape. Both end portions of the ring band 5 are fixed with a fixing means such as bolts and nuts to put the upper spherical portion 1*a* and the lower spherical portion 1*b* together for the purpose of forming the body 1 into a spherical shape. The upper and lower spherical portions 1*a* and 1*b* can be formed by spinning or the like.

The introduction pipe 2 is mounted on a peripheral surface of the upper portion 1*a* of the body 1. The gas exhaust pipe 3 is disposed so that it elongates in the central direction of the body 1 from the uppermost portion of the upper portion 1*a* of the body 1. The particle ejection pipe 4 is disposed at the bottom of the lower portion of the body 1. There is a valve 6 disposed under the bottom.

Then the operation and the action of the spherical cyclone A will be described. Particle-containing gases are introduced into the body 1 through the introduction pipe 2 by way of a blower or the like. The gases rotate along the inner wall surface of the body 1 in a state of a whirl to be a descending whirling current, while a centrifugal force is developed to the particles so that the particles are transferred towards the direction of the wall of the body 1 to be separated from the current. The separated particles are ejected to the outside of the body 1 from the particle ejection pipe 4 by way of the valve 6. The whirling current will be increased in diameter, while descending to the middle portion of the body 1, to be reduced in flowing speed. While further going down from the middle portion of the body 1 to the lower portion, the whirling current is reduced in diameter and the speed of the current will be increased. At this time an ascending current is produced in the central portion of the body 1 to be exhausted through the gas exhaust pipe 3 to the outside of the body 1. The shape of the body 1 causes such a whirling current as above to be developed within the body 1 so that the pressure loss in the body 1 can be lowered. Higher speeds of the current attainable in both the upper and the lower portions of the body 1 allow the particles which have escaped separation in the upper portion to be separated in the lower portion. Possession of a separation power twice both in the upper and the lower portions causes a large amount of particles contained in the gases to be removed.

As shown in FIG. 3 illustrating attachment of a spraying nozzle (generally referred to as a cyclone scrubber) to the spherical cyclone A, a spraying nozzle 7 is inserted into the lower portion 1*b* of the body 1 for spraying water or the like towards the center of the body 1. Further, a liquid-level sensor 8 is attached within the lower portion of the body 1. An automatic valve 6*a* which is actuated by way of the liquid-level sensor is mounted under the particle ejection pipe 4.

The liquid-level sensor 8 is composed of an upper float switch 8*a* and a lower float switch 8*b*. A rise of the liquid level causes the upper float switch 8*a* to actuate to keep the automatic valve 6*a* open. A fall of the liquid level causes the lower float switch 8*b* to actuate to keep the automatic valve 6*a* closed. This prevents the water or the like sprayed in the body 1 to be accumulated too much in the body 1. Water sprayed from the nozzle is collided with the particles in the current with a consequence that the diameter of the particles will be increased to facilitate separation of the particles from the gases.

A case where the cyclone A stated above is provided with cooling/heating pipes will be described.

As shown in FIG. 4, a pipe 9 is wound around the outer periphery of the body 1 in a state of a coil. The pipe 9 is connected to a cooler or heater not shown. A refrigerant is passed in the pipe 9 for cooling the body 1. Cooling the body 1 allows the temperature within the body to be lowered for the purpose of dehumidifying the gases within the body 1 so that the separation of the particles from the gases can be promoted. The cooling-/heating pipe can be coiled around the gas exhaust pipe 3 which elongates into the body 1.

This invention is not limited to the embodiments stated above. For example, the upper portion 1*a* and the lower portion 1*b* of the body 1 can be welded together for assembling.

This invention which is constructed as above has a following effect:

Formation of the body of the cyclone in the shape of a sphere causes the cyclone to be compact in volume. This allows the pressure loss to be reduced with an advantage that the cyclone can be operated by a blower whose gas capacity is small.

What is claimed is:

1. A cyclone for separating particles from particle-containing fluids comprising:

a substantially spherical housing having an upper portion and a lower portion and defining therewithin a separation chamber;

inlet means mounted to a peripheral surface of said upper portion for introducing particle-containing fluid into said separation chamber;

outlet means defined through said upper portion including an outlet pipe extending into said separation chamber and centrally through said separation chamber, said outlet pipe being non-perforate at least along the length thereof disposed in said upper portion and having an inlet opening defined in said lower portion of said spherical housing; and particle outlet means defined through the lower portion of said spherical housing.

2. A cyclone as in claim 1, wherein said particle outlet means is defined through a central portion of said lower portion of said spherical housing.

3. A cyclone as in claim 2, further comprising liquid spraying means operatively coupled to said lower portion for spraying a liquid into said separation chamber, towards the center of said spherical housing.

4. A cyclone as in claim 3, further comprising valve means operatively coupled to said particle outlet means for controlling the flow of particles through said outlet means.

5. A cyclone as in claim 4, further comprising a liquid level sensor means mounted within said separation chamber in said lower portion of said spherical housing for sensing the level of liquid within said lower portion of said spherical housing.

6. A cyclone as in claim 5, wherein said liquid level sensor means is operatively coupled to said valve means for maintaining said valve means in an open disposition when the liquid level in said lower portion exceeds a predetermined level and for maintaining said valve means in a closed disposition when the liquid in said lower portion is lower than a predetermined level.

7. A cyclone as in claim 1, further comprising a heat exchange conduit means operatively coupled to an exterior surface of said spherical housing for controlling the temperature of said spherical housing.

8. A cyclone as in claim 7, wherein said heat exchange means comprises a pipe spirally wound about the exterior of said spherical housing for receiving one of a cooling fluid and a heating fluid for controlling the temperature of said spherical housing.

9. A cyclone as in claim 1, wherein said inlet means defines a substantially unobstructed entry passage for said particle-containing fluid into said separation chamber.

10. A cyclone as in claim 1, wherein said spherical housing has a substantially unobstructed interior surface whereby turbulence within said separation chamber is minimized.

* * * * *